US011235601B2

(12) United States Patent
Park et al.

(10) Patent No.: US 11,235,601 B2
(45) Date of Patent: Feb. 1, 2022

(54) PRINTER

(71) Applicant: MANGOSLAB CO., LTD., Seongnam-si (KR)

(72) Inventors: Yong Shik Park, Seongnam-si (KR); Yong Soo Jeong, Seongnam-si (KR)

(73) Assignee: MANGOSLAB CO., LTD., Seongnam-si (KR)

( * ) Notice: Subject to any disclaimer, the term of this patent is extended or adjusted under 35 U.S.C. 154(b) by 0 days.

(21) Appl. No.: 16/801,905

(22) Filed: Feb. 26, 2020

(65) Prior Publication Data

US 2020/0269616 A1 Aug. 27, 2020

(30) Foreign Application Priority Data

Feb. 27, 2019 (KR) ..... 10-2019-0023338

(51) Int. Cl.
*B41J 15/04* (2006.01)

(52) U.S. Cl.
CPC ..... *B41J 15/046* (2013.01); *B41J 15/044* (2013.01)

(58) Field of Classification Search
CPC ..... B41J 15/046; B41J 15/044
See application file for complete search history.

(56) References Cited

U.S. PATENT DOCUMENTS 5,346,457 A * 9/1994 Kimura ..... B65H 23/34 162/271
5,519,512 A * 5/1996 Bandai ..... H04N 1/00525 358/474
5,533,821 A 7/1996 Awai et al.
5,739,925 A * 4/1998 Kameyama ..... H04N 1/00519 358/496
9,950,543 B2 * 4/2018 Kim ..... B41J 11/0005
2004/0081500 A1 * 4/2004 Hoshino ..... B41J 2/32 400/120.01
2007/0212146 A1 * 9/2007 Lyons ..... B41J 3/60 400/82
2018/0134049 A1 5/2018 Jeong et al.
2021/0268810 A1 * 9/2021 Park ..... B41J 15/044

FOREIGN PATENT DOCUMENTS

CN 106573744 A 4/2017
EP 3 196 155 A1 7/2017
KR 1020160152570 * 11/2016 ..... B41J 15/044

* cited by examiner

*Primary Examiner* — David H Banh
(74) *Attorney, Agent, or Firm* — Studebaker & Brackett PC

(57) ABSTRACT

A printer for pulling out a paper wound in a form of a wound roll is disclosed. The printer may comprise a cartridge configured to accommodate the paper, a housing in which the cartridge is mounted, a cover moveable between an open position for opening the top surface of the housing and a closed position for closing the top surface of the housing, a first printing unit mounted to the housing, and a second printing unit mounted to the cover. The paper is pulled out between the first printing unit and the second printing unit, and the second printing unit has a decurling part formed thereon. The decurling part comes into surface-contact with the paper on the upper side of the paper in the process of pulling out the paper when the cover is in the closed position.

9 Claims, 15 Drawing Sheets

PRINTER

CROSS-REFERENCE TO RELATED APPLICATION

This application claims priority under 35 U.S.C. § 119 to Korean Patent Application No. 10-2019-0023338, filed in the Korean Intellectual Property Office on Feb. 27, 2019, the entire contents of which are hereby incorporated by reference.

TECHNICAL FIELD

The present invention relates to a printer. More particularly, the present invention relates to a printer capable of preventing a paper from being pulled out in a curled state by decurling the paper in the process of pulling out the wound paper.

BACKGROUND

Generally, printers are devices configured to receive electric signals or the like to print a paper which is accommodated in the printers. Due to the miniaturization of printers, printers pull out a paper wound in the form of a roll to print the paper. Especially, printers are frequently used in commercial shops, where receipts, recording papers, or the like are used. Printers may also be used for printing photographed pictures in a short time with the development of image-capturing devices such as digital cameras, or the like. Therefore, printers are expected to be used in more various fields in the future (for example, as a portable printer or the like).

Such printers perform a printing operation using a method such as driving a printing unit to transfer ink on a paper while pulling out the wound roll-shaped paper. However, in a conventional printer, even after a wound roll-shaped paper is pulled out, the paper is kept in the curled roll shape, and thus handling of the pulled-out paper may be cumbersome.

Problem to be Solved

An objective of the present invention is to provide a device capable of decurling a paper with a minimal structure.

Another objective of the present invention is to provide a device capable of preventing a paper and the contect on the paper from being altered in the process of pulling out the paper.

Still another objective of the present invention is to provide a device capable of decurling a paper with a uniform force so as to prevent the pulled-out paper from being curled.

Yet another objective of the present invention is to provide a device capable of decurling a paper with a uniform force so as to have the pulled-out paper in a flat state.

Still yet another objective of the present invention is to provide a device capable of printing on paper of various thicknesses by simply exchanging the cartridge without other structural modifications to the printer.

Still yet another objective of the present invention is to provide a device capable of selectively performing decurling a paper by simply exchanging the cartridge without other structural modifications to the printer.

SUMMARY

The present disclosure provides a printer for pulling out a paper wound in a form of a wound roll. According to one aspect of the present disclosure, the printer comprises a cartridge configured to accommodate the paper, a housing in which the cartridge is mounted, a cover moveable between an open position for opening the top surface of the housing and a closed position for closing the top surface of the housing, a first printing unit mounted to the housing, and a second printing unit mounted to the cover. The paper is pulled out between the first printing unit and the second printing unit, and the second printing unit has a decurling part formed thereon. The decurling part comes into surface-contact with the paper on the upper side of the paper in the process of pulling out the paper when the cover is in the closed position.

In one embodiment of the present invention, a portion of the decurling part that comes into surface-contact with the paper has a first curvature radius.

In one embodiment of the present invention, the cartridge comprises a decurl guide part that comes into surface-contact with the paper on the lower side of the paper in the process of pulling out the paper.

In one embodiment of the present invention, a portion of the decurling part that comes into surface-contact with the paper has a first curvature radius, a portion of the decurl guide part that comes into contact with the paper has a second curvature radius, and the first curvature radius is smaller than the second curvature radius.

In one embodiment of the present invention, the height from the bottom surface of the housing to the center of the curvature radius of the decurl guide part is greater than the height from the bottom surface of the housing to the rotational center axis of the paper in the housing.

In one embodiment of the present invention, the height from the bottom surface of the housing to the center of the curvature radius of the decurl guide part is greater than the height from the bottom surface of the housing to the center of the curvature radius of the decurling part.

In one embodiment of the present invention, the center of the curvature radius of the decurl guide part is disposed between the rotational center axis of the paper in the housing and the center of the curvature radius of the decurling part, and the paper is decurled by the pressure applied by the decurling part while passing through a space between the center of the curvature radius of the decurl guide part and the center of the curvature radius of the decurling part.

In one embodiment of the present invention, a step is formed in the decurl guide part such that the height of a portion corresponding to a path where an adhesive portion of the paper passes through is lower than the height of a portion corresponding to a path where the adhesive portion of the paper does not pass through, and a step is formed in the decurling part such that the height of a portion corresponding to a path where the adhesive portion of the paper passes through is lower than the height of a portion corresponding to a path where the adhesive portion of the paper does not pass through.

In one embodiment of the present invention, the decurling part applies pressure to the upper portion of the paper in a direction opposite to a direction in which the paper is wound in the cartridge thereby decurling the paper being pulled out.

In one embodiment of the present invention, the second printing unit is disposed at a position facing the first printing unit when the cover is in the closed position. The first printing unit comprises a thermal head configured to perform printing on the paper and the second printing unit comprises a feed roller configured to rotate in a direction opposite to the direction in which the paper is unwound while pressing the thermal head to convey the paper. Alternatively, the second printing unit comprises a thermal head configured to perform printing on the paper and the first printing unit comprises a feed roller configured to rotate in a direction opposite to a direction in which the paper is unwound while pressing the thermal head to convey the paper.

Advantageous Effects

According to the present invention, a separate roller for decurling a paper can be omitted, and thus the size of a printer can be reduced.

According to the present invention, it is possible to prevent a paper from deforming due to excessive force and heat in the process of decurling the paper, thereby improving the quality of the drawn paper and the print quality.

According to the present invention, it is possible to print various types of paper by simply exchanging the cartridge without other structural modifications to the printer.

According to the present invention, it is possible to selectively perform decurling of a paper by simply exchanging the cartridge without other structural modifications to the printer.

DETAILED DESCRIPTION

Figure 1:
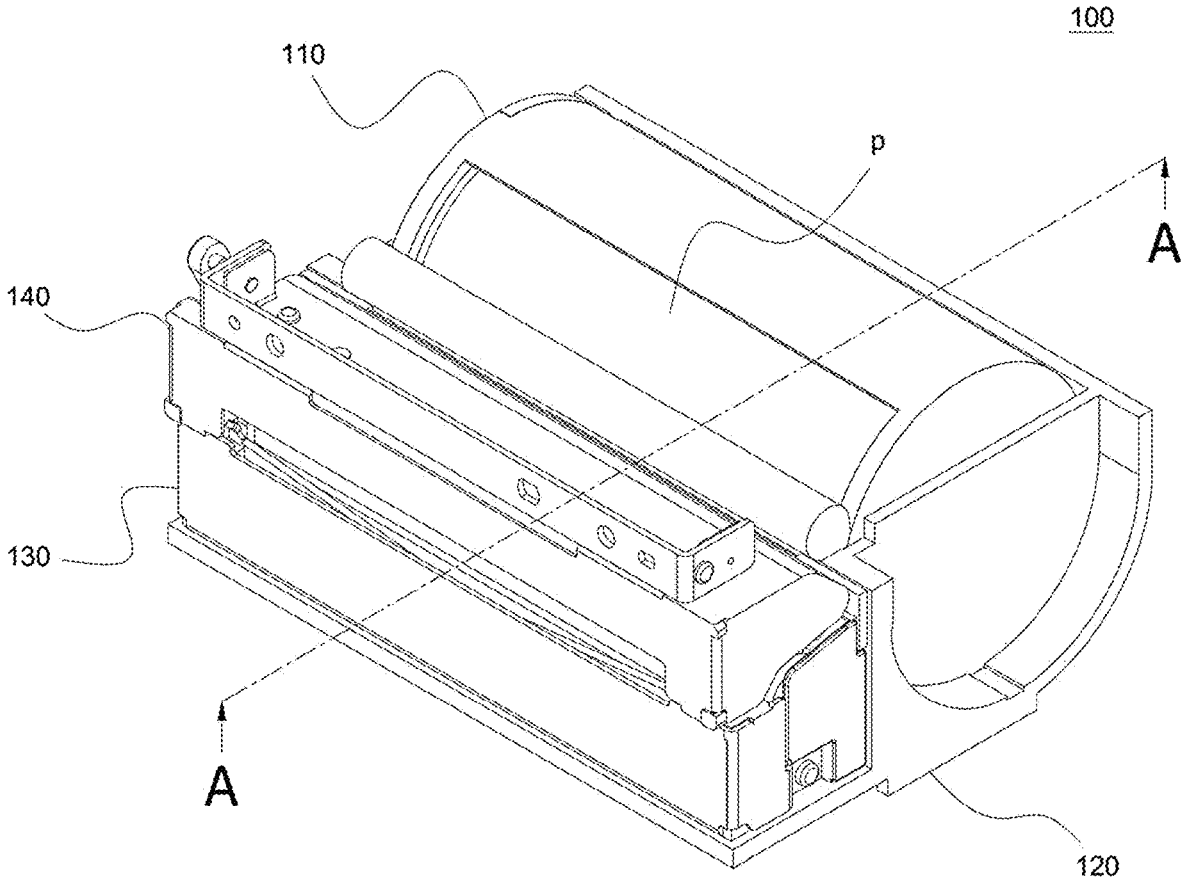
FIG. 1 is a perspective view illustrating a printer according to an embodiment of the present invention.

Hereinafter, embodiments of the present invention will be described in detail with reference to the accompanying drawings so that those of ordinary skill in the art may easily implement them. However, the present invention may be implemented in various forms and is not limited to the embodiments described below. Further, portions irrelevant to the present invention are omitted in the drawings in order to clearly explain the present invention, and the same or similar reference numerals in the drawings denote the same or similar elements.

The objects and effects of the present invention may be naturally understood or become more apparent based on the following description, and the objects and effects of the present invention are not limited only to the following description.

The above and other objects, features, and advantages of the present invention will become more apparent through the following detailed description. When it is determined that detailed descriptions of related well-known functions unnecessarily obscure the gist of the present invention during the description of the present invention, the detailed descriptions will be omitted.

Prior to describing the present invention in detail, unless otherwise stated, "upper side" refers to a side over an upper surface or an outer surface of the paper being transported while the roll-shaped paper accommodated in a cartridge of a printer is being pulled out. "Lower side" refers to a side under a bottom surface or an inner surface of the paper being transported while the roll-shaped paper accommodated in the cartridge of a printer is being pulled out.

Figure 4:
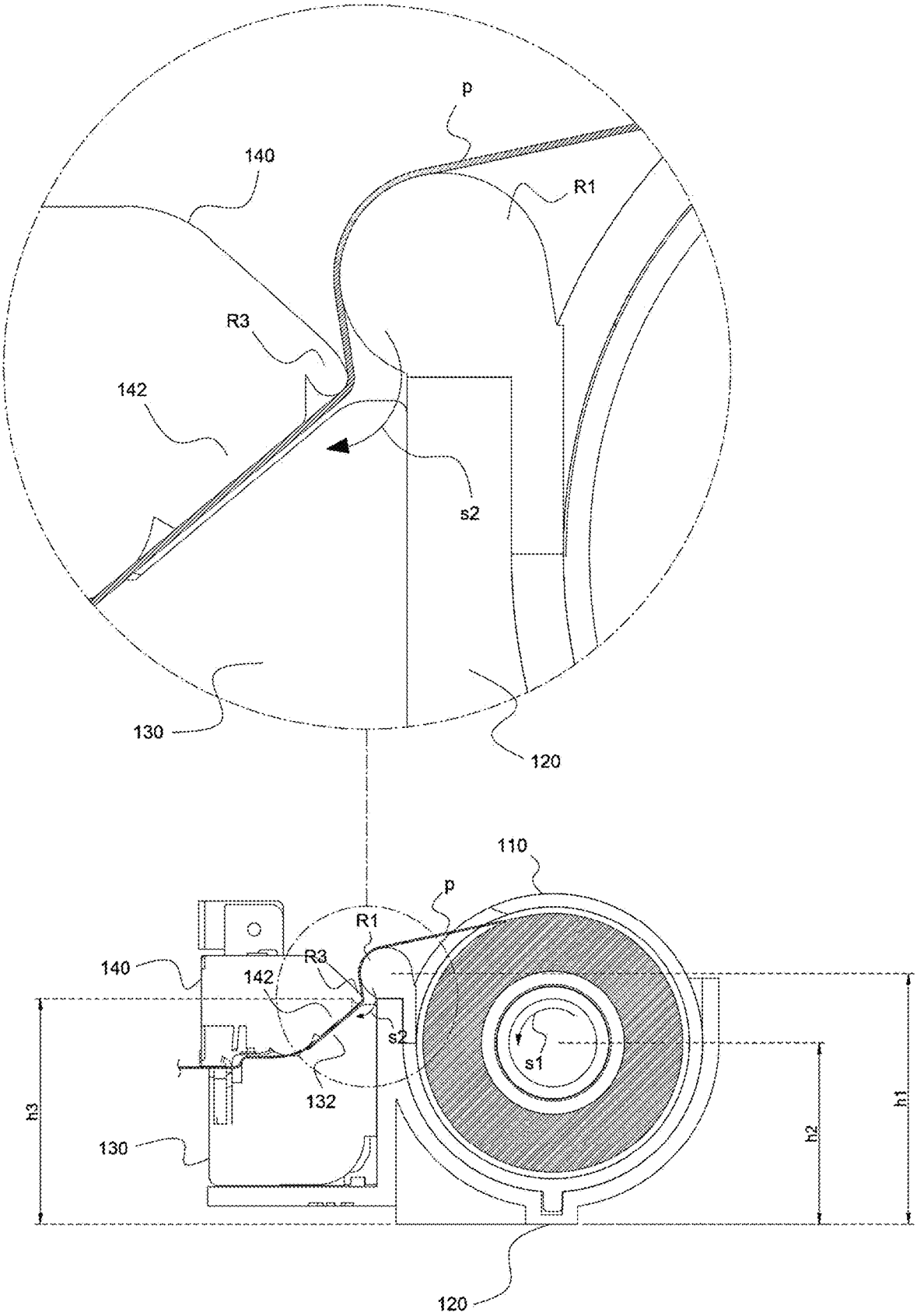
FIG. 4 is a cross-sectional view of a printer according to an embodiment of the present invention illustrating a path through which a paper is decurled and pulled out.

"Curl direction" refers to an inward direction on the basis of a paper p being curled like reference numeral "s1" in FIG. 4. "Decurl direction" refers to an outward direction on the basis of the paper p being curled like reference numeral "s2" in FIG. 4. "Decurl" refers to flattening the paper p curled in the curl direction of the roll shape of the accommodated paper.

Figure 7:
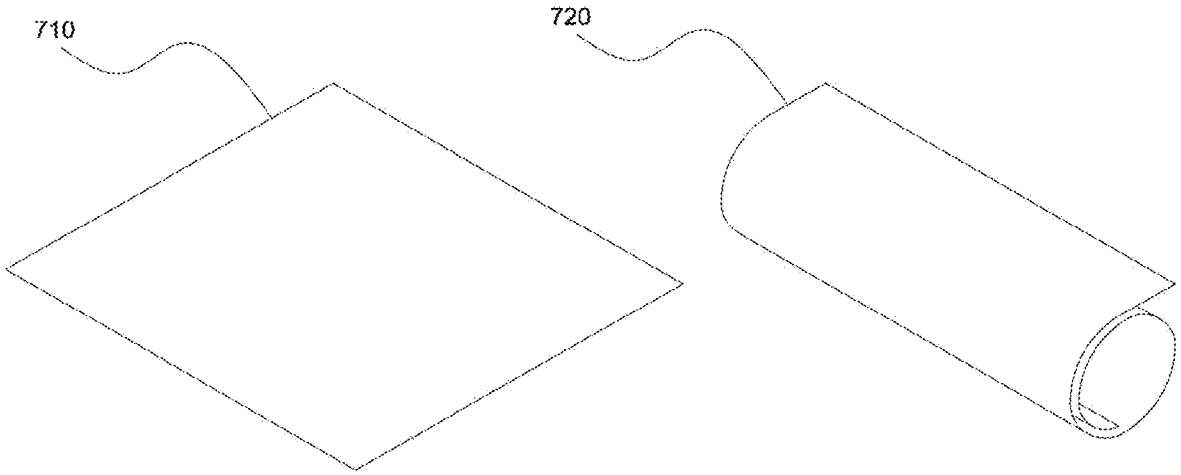
FIG. 7 is a perspective view illustrating a decurled paper and a paper that is not decurled.

"Predetermined direction" refers to a direction in which the paper accommodated in the cartridge is pulled out, for example, in a lower leftward direction in FIG. 1 and a leftward direction in FIG. 7.

FIG. 1 is a perspective view illustrating a printer 100 according to an embodiment of the present invention. The printer 100 may include a cartridge 110 configured to accommodate a paper p, a housing 120 in which the cartridge 110 is mounted, and a first printing unit 130 and a second printing unit 140 configured to print and pull out the paper p. In one embodiment, the printer 100 may include a cover (not shown) movable between an open position for opening the top surface of the housing 120 and a closed position for closing the top surface of the housing 120. In this case, the first printing unit 130 may be mounted to the housing 120, and the second printing unit 140 may be mounted to the cover (not shown). The second printing unit 140 may be disposed at a position facing the first printing unit 130 when the cover (not shown) is in the closed position. At this time, the content may be printed as the paper p passes between the first printing unit 130 and the second printing unit 140.

A decurling part R3 (see FIG. 3) may be formed on the second printing unit 140. The decurling part R3 may apply pressure to the upper portion of the paper p in a direction (decurl direction; s2, see FIG. 4) opposite to a direction (curl direction; s1, see FIG. 4) in which the paper p is wound in the cartridge 110 thereby decurling the paper. A decurl guide part R1 (see FIG. 3) may be formed on cartridge 110. The decurl guide part R1 may be used to form a movement path of the paper p so that the paper p may be decurled by the decurling part R3 (see FIG. 3). The decurl guide part R1 (see FIG. 3) and decurling part R3 (see FIG. 3) comes into surface-contact with the paper p on upper and lower sides of the paper p in the process of the paper p passing through the first printing unit 130 and the second printing unit 140 and being pulled out.

The paper p may be wound in the form of a roll and accommodated in the cartridge 110. The accommodated paper p may be printed by a thermal head (not shown) of the first printing unit 130 and pulled out in the predetermined direction by a feed roller (not shown) of the second printing unit 140. The feed roller (not shown) may be configured to rotate in the direction opposite to the direction in which the paper p is unwound, and apply pressure to the thermal head (not shown) to thereby convey the paper p. In another embodiment, the first printing unit 130 may include a feed roller (not shown), and the second printing unit 140 may include a thermal head (not shown).

Figure 2:
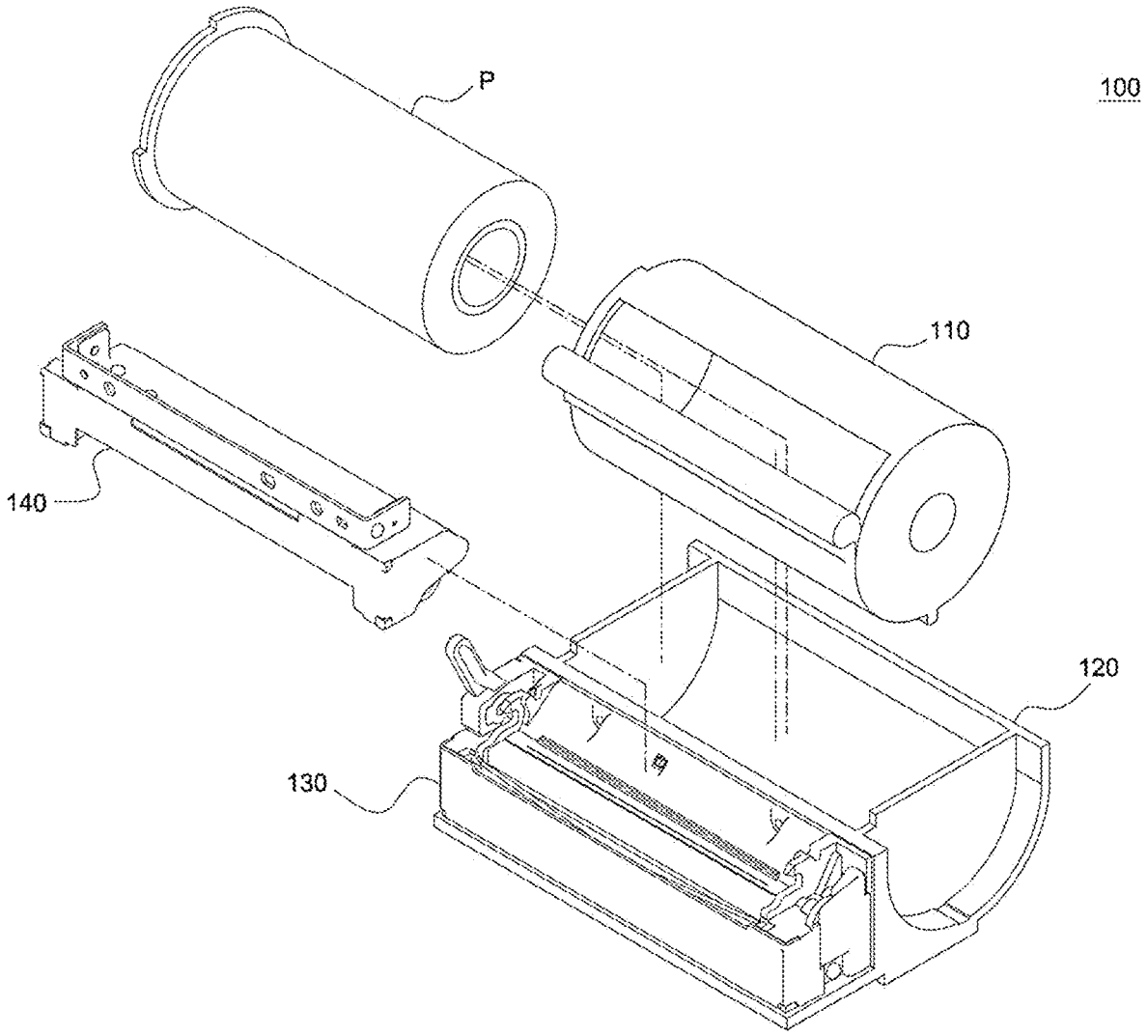
FIG. 2 is an exploded perspective view illustrating the printer according to an embodiment of the present invention.

FIG. 2 is an exploded perspective view illustrating the printer 100 according to an embodiment of the present invention. The printer 100 may include a cartridge 110 configured to accommodate a paper p, a housing 120 in which the cartridge 110 is mounted, and a first printing unit 130 and a second printing unit 140 configured to print and pull out the paper p.

The cartridge 110 is a structure for accommodating the paper p. In particular, there is a space formed in the cartridge 110 for accommodating the paper p wound in a roll shape, and the cartridge 110 may be formed in a cylindrical shape having an opening in a side surface (e.g., left side surface). In addition, the cartridge 110 is mounted to the housing 120. For example, the cartridge 110 may be provided with a separate protrusion for coupling with the housing 120, and the protrusion may prevent the cartridge 110 from being separated from the housing 120 by an external force after the cartridge 110 is mounted to the housing 120. The cartridge 110 is mounted to the housing 120 while accommodating the paper p therein and may continuously supply the paper p to the first printing unit 130 and the second printing unit 140.

The upper surface of the housing 120 may include an opening corresponding to the shape of the cartridge 110 having a cylindrical shape. In addition, an insertion groove corresponding to the separate protrusion formed on the cartridge 110 may be further provided in the housing 120 for a firmer coupling with the cartridge 110. Accordingly, the housing 120 may secure the cartridge 110 in a state where the cartridge 110 is accommodated in the housing 120.

The paper p supplied from the cartridge 110 mounted to the housing 120 passes through the first printing unit 130 and the second printing unit 140, and the printer prints on the paper p as the paper p passes through the first printing unit 130 and the second printing unit 140 (see FIG. 4). In one embodiment, the first printing unit 130 may include a thermal head (not shown) disposed in the movement path of the paper p in the predetermined direction, and the second printing unit 140 may include a feed roller (not shown) that moves the paper p in the predetermined direction. In another embodiment, the second printing unit 140 may include the thermal head (not shown) disposed in the movement path of the paper p in the predetermined direction, and the first printing unit 130 may include the feed roller (not shown) that moves the paper p in the predetermined direction.

The thermal head (not shown) may come into contact with the paper p and apply heat to perform printing by selectively heating a plurality of separately provided heating elements. The feed roller (not shown) may move the paper p in the predetermined direction and pull the paper p out of the printer. Through the above-described series of configurations, the first printing unit 130 and the second printing unit 140 may easily print the paper p supplied from the cartridge 110 and pull the paper p out in the predetermined direction.

Figure 3:
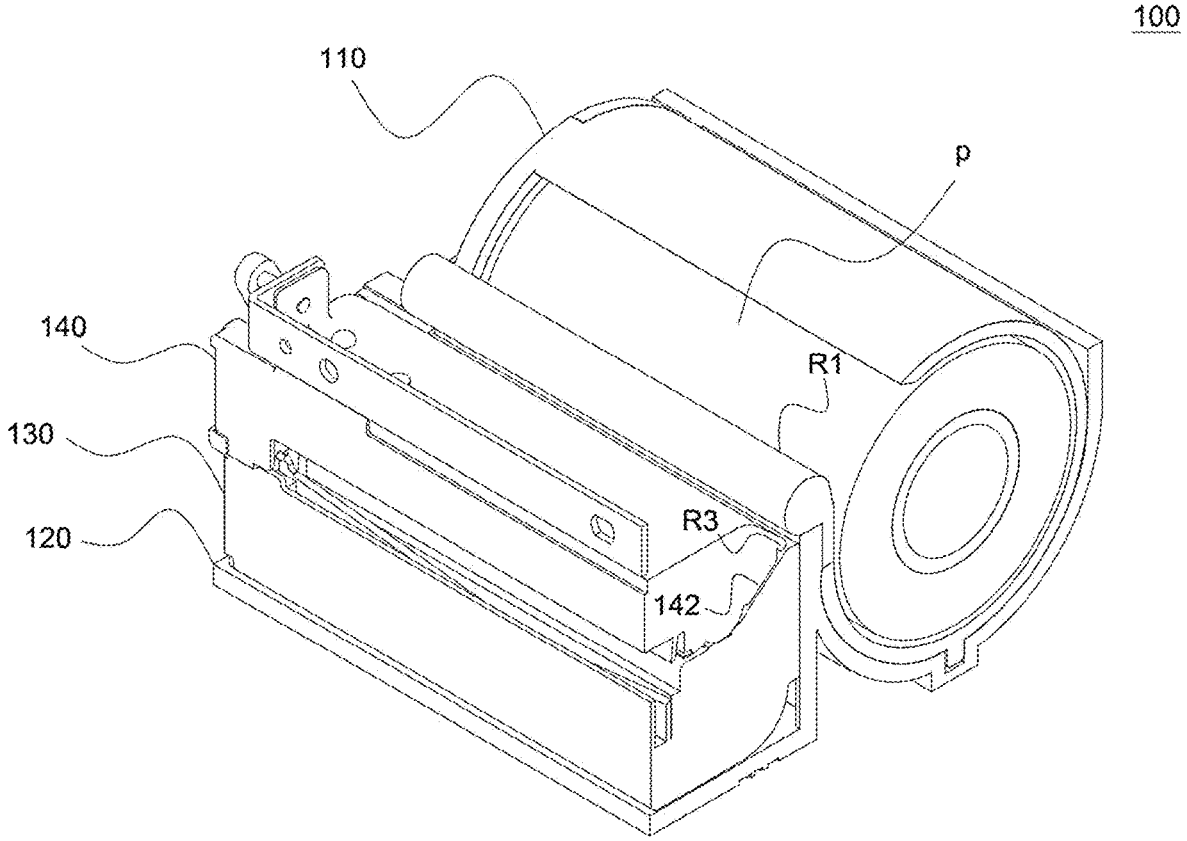
FIG. 3 is a perspective view showing the A-A cross section of the printer shown in FIG. 1.

FIG. 3 is a perspective view showing the A-A cross section of the printer 100 shown in FIG. 1. The printer 100 may include a cartridge 110 configured to accommodate a paper p, a housing 120 in which the cartridge 110 is mounted, and a first printing unit 130 and a second printing unit 140 configured to print and pull out the paper p. A decurl guide part R1 may be formed on cartridge 110. The decurl guide part R1 may be used to form a movement path of the paper p so that the paper p may be decurled by the decurling part R3. A decurling part R3 may be formed on the second printing unit 140. The decurling part R3 may apply pressure to the upper portion of the paper p in a direction s2 (see FIG. 4; decurl direction) opposite to a direction (curl direction) in which the paper p is wound in the cartridge 110 thereby decurling the paper.

In one embodiment, a portion of the decurling part R3 that comes into surface-contact with the paper p may be formed as a curved surface having a predetermined curvature radius (first curvature radius), and a portion of the decurl guide part R1 that comes into surface-contact with the paper may be formed as a curved surface having a predetermined curvature radius (second curvature radius). In this case, the first curvature radius of the decurling part R3 may be smaller than the second curvature radius of the decurl guide part R1. The decurling part R3 prevents the paper p from being curled by decurling the paper p while the paper p accommodated in the cartridge 110 moves past the decurl guide part R1. In particular, the decurling part R3 comes into surface-contact with the paper p on the upper side of the paper p so that the pulled-out paper p is prevented from being rewound. At this time, the decurl guide part R1 and the paper guide part 142, which is formed on the second printing unit 140, may come into surface-contact with the paper p to support the paper p so as to hold up the pressure applied to the paper p by the decurling part R3.

FIG. 4 is a cross-sectional view of a printer according to an embodiment of the present invention illustrating a path through which a paper is decurled and pulled out. The paper p accommodated in the cartridge 110 mounted to the housing 120 is drawn out along the curl direction s1 of the cartridge 110 and passes through the first printing unit 130 and the second printing unit 140. In this process, the paper p is decurled by the decurling part R3. The decurling part R3 comes into surface-contact with the paper p on the upper side of the paper in a decurl direction so that the pulled-out paper p is prevented from being rewound. At this time, the decurl guide part R1 and the paper guide part 142 may come into surface-contact with the paper p to hold up the pressure applied to the paper p by the decurling part R3.

According to one embodiment, the decurl guide part R1 may be formed on the cartridge 110, and the paper guide part 142 and the decurling part R3 may be formed on the second printing unit 140. For example, the cartridge 110 may have a protrusion-shaped decurl guide part R1 that comes into surface-contact with the lower side of the paper while the paper p is withdrawn. The second printing unit 140 may have a protrusion-shaped decurling part R3 that comes into surface-contact with the upper side of the paper while the paper p is withdrawn.

The decurl guide part R1 may come into surface-contact with the paper p on the lower side of the paper p while the paper p is withdrawn. As shown, the portion of the decurling part R3 that comes into contact with the paper p may have a first curvature radius, the portion of the decurl guide part R1 that comes into contact with the paper p may have a second curvature radius, and the first curvature radius may be smaller than the second curvature radius. In FIG. 7, the paper guide part 142 is illustrated to have an inclination but it is not limited thereto.

As shown, the decurl guide part R1 has a fixed position in relation to the housing during the operation of the printer. The height h1 from the bottom surface of the housing 120 to the center of the curvature radius of the decurl guide part R1 may be greater than the height h2 from the bottom surface of the housing 120 to the rotational center axis of the paper p in the housing 120. In addition, the height h1 from the bottom surface of the housing 120 to the center of the curvature radius of the decurl guide part R1 may be greater than the height h3 from the bottom surface of the housing 120 to the the center of the curvature radius of the decurling part R3. The center of the curvature radius of the decurl guide part R1 may be disposed between the rotational center axis of the paper p in the housing 120 and the center of the curvature radius of the decurling part R3. With this configuration, the paper p may be decurled by the pressure applied by the decurling part R3 as the paper p passes through the space between the center of the curvature radius of the decurl guide part R1 and the center of the curvature radius of the decurling part R3. At this time, the decurling part R3 may apply pressure to the upper side of the paper p in a direction s2 (decurl direction) that is opposite to the direction s1 (curl direction) in which the paper p is wound in the cartridge 110 thereby decurling the paper p.

By the above-described configuration, it is possible to minimize the space required for decurling the paper p by omitting a separate decurl roller. Accordingly, the printer may be easily miniaturized. The decurling part R3 and the decurl guide part R1, which respectively have the first curvature radius and the second curvature radius, prevents the paper p from being excessively bent while coming into surface-contact with the paper p so that unnecessary deformation of the paper p may be prevented. In addition, wear and tear of the paper p may be prevented compared to the case where the corner of the guide part, which comes into contact with the paper p, has a right angle.

Figure 5:
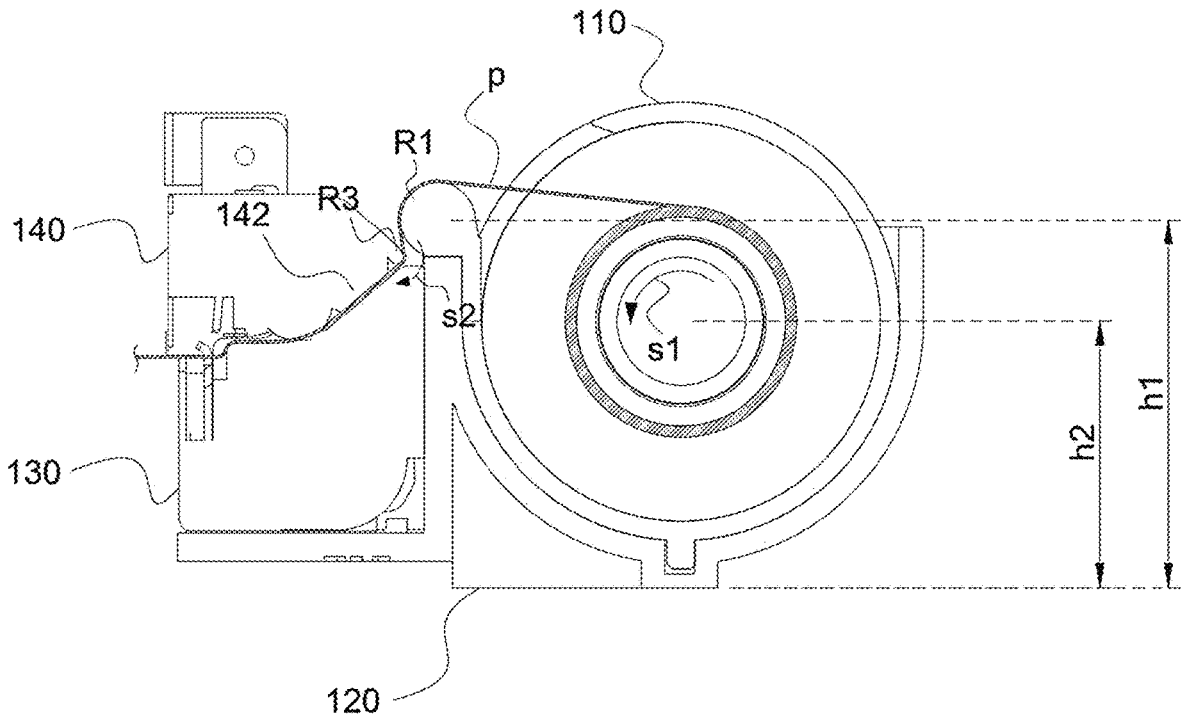
FIG. 5 is a cross-sectional view of a printer according to an embodiment of the present invention illustrating change of the paper movement path according to the consumption of the paper.
Figure 8:
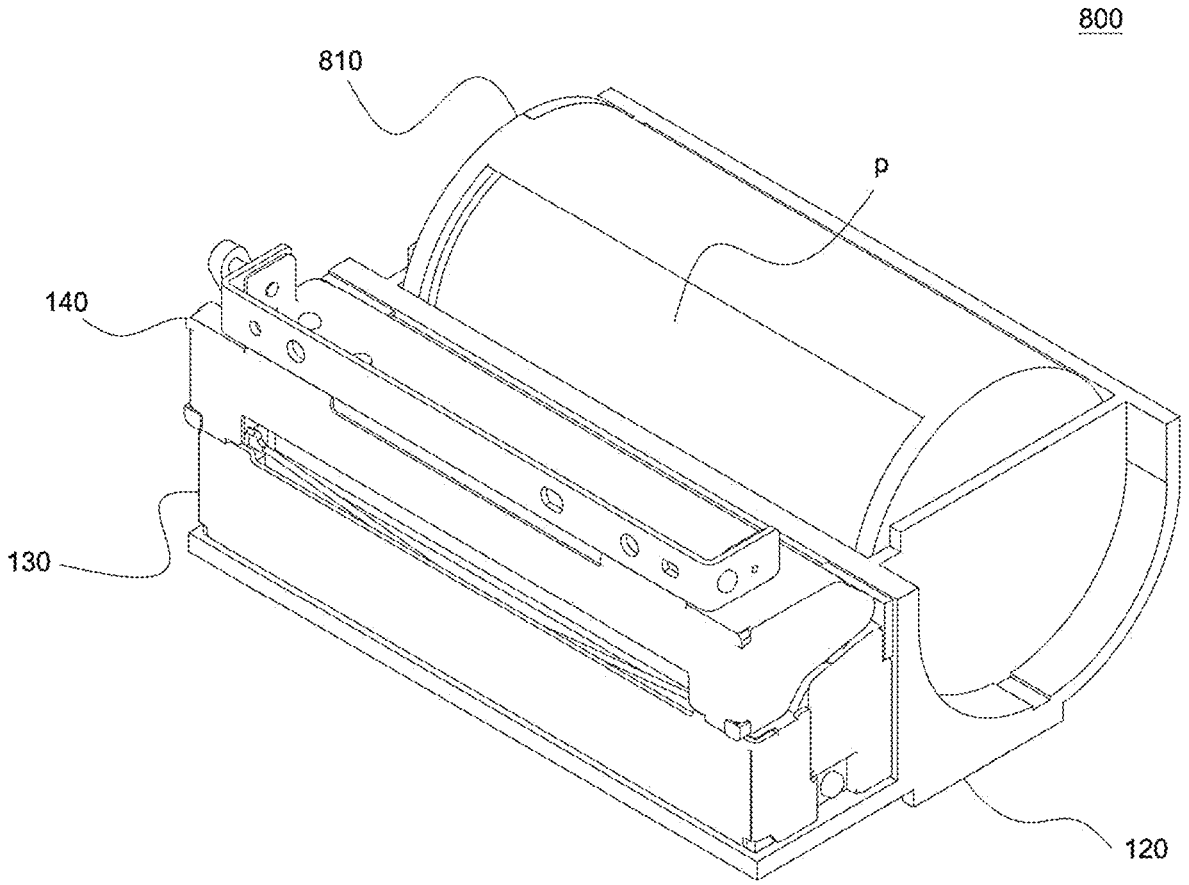
FIG. 8 is a perspective view of a printer without a decurl guide part.

FIG. 5 is a cross-sectional view of a printer according to an embodiment of the present invention illustrating change of the paper movement path according to the consumption of the paper p. As shown in FIG. 8, as the paper p in the cartridge 110 is exhausted, the height of the paper p wound in the cartridge 110 becomes smaller, and the height from the bottom surface of the housing to the top portion of the paper p in the cartridge 110 also becomes smaller. Herein, the height h2 from the bottom surface of the housing 120 to the rotational center axis of the paper p in the housing 120 is configured to be smaller than the height h1 from the bottom surface of the housing 120 to the center of the curvature radius of the decurl guide part R1. By this configuration, sagging of the paper p is prevented by the decurl guide part R1 even when the amount of paper p in the cartridge 110 decreases. In one embodiment, the decurl guide part R1 may be formed adjacent to the outlet of the cartridge 110. By this configuration, the movement path of the paper p after it is withdrawn from the cartridge 110 may be kept constant, thereby preventing the decurling effect of the decurling part R3 from decreasing as the paper p in the cartridge 110 is consumed.

Figure 6:
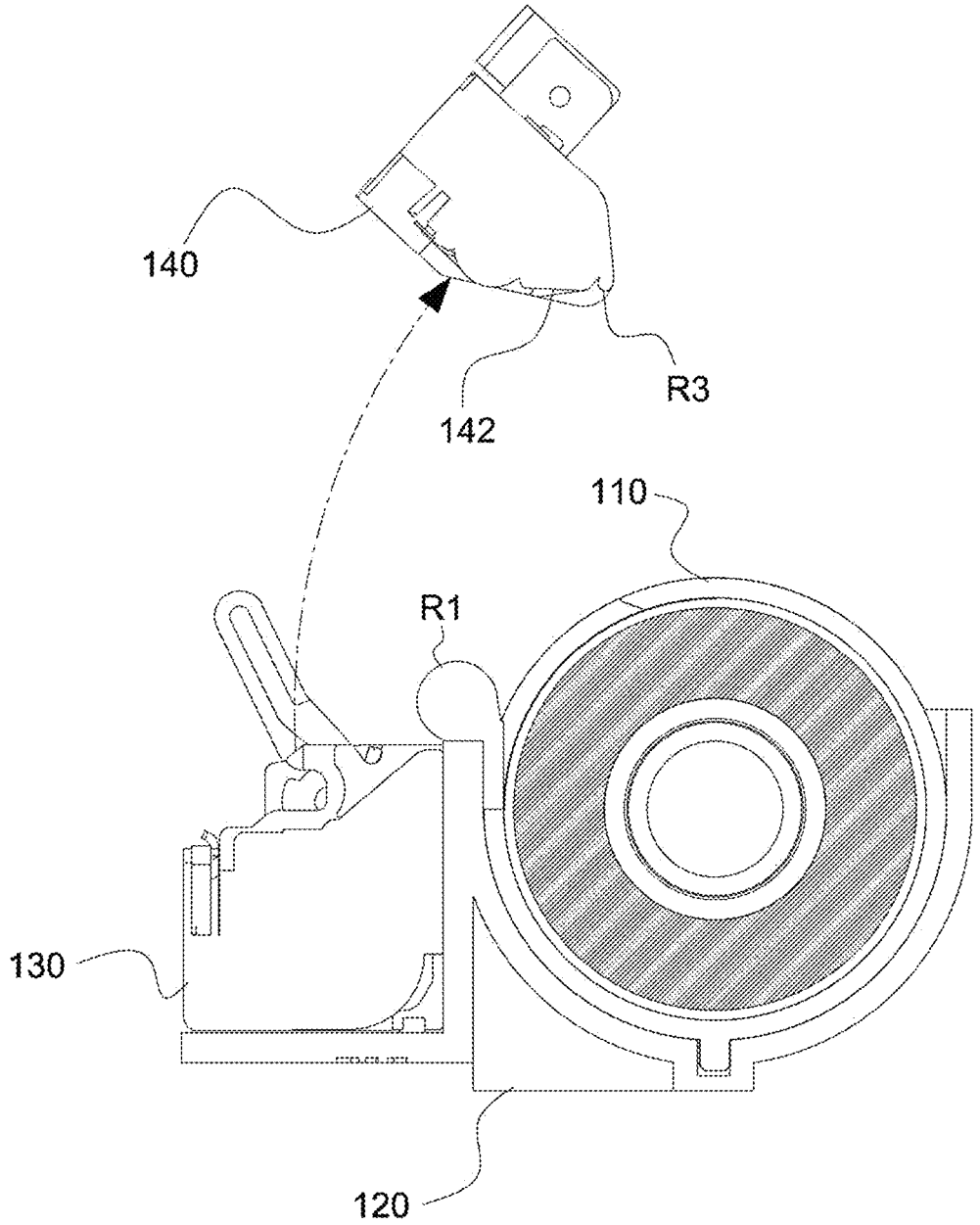
FIG. 6 is a cross-sectional view of a printer according to an embodiment of the present invention illustrating the movement of a second printing unit as the cover moves between an opening and closing position.

FIG. 6 is a cross-sectional view of a printer 100 according to an embodiment of the present invention illustrating the movement of a second printing unit as the cover moves between an opening and closing position. In one embodiment, the printer 100 may include a cover (not shown) movable between an open position for opening the top surface of the housing 120 and a closed position for closing the top surface of the housing 120. In this case, the first printing unit 130 may be mounted to the housing 120, and the second printing unit 140 may be mounted to the cover (not shown). The second printing unit 140 may be disposed at a position facing the first printing unit 130 when the cover (not shown) is in the closed position. At this time, the content may be printed as the paper p passes between the first printing unit 130 and the second printing unit 140. In addition, when the cover (not shown) moves to the open position, the second printing unit 140 may move together with the cover (not shown) to be spaced apart from the first printing unit 130.

FIG. 7 is a perspective view illustrating a decurled paper 710 and a paper 720 that is not decurled. In a conventional printer, even after a wound roll-shaped paper p is pulled out, the paper 720 is kept in the roll shape curled in a roll direction s1 (curl direction), and thus handling of the pulled-out paper may be cumbersome. On the other hand, in the printer 100 according to one embodiment of the present disclosure, the paper p is decurled in the decurl direction s2, which is opposite to the curl direction s1, by the decurling part R3 such that a flat paper 710 is withdrawn. FIG. 8 is a perspective view of a printer 800 without a decurl guide part. The illustrated printer 800 may include a cartridge 810 configured to accommodate a paper p, a housing 120 in which the cartridge 810 is mounted, and a first printing unit 130 and a second printing unit 140 configured to print and pull out the paper p. In one embodiment, the printer 800 may include a cover (not shown) movable between an open position for opening the top surface of the housing 120 and a closed position for closing the top surface of the housing 120. In this case, the first printing unit 130 may be mounted to the housing 120, and the second printing unit 140 may be mounted to the cover (not shown). The second printing unit 140 may be disposed at a position facing the first printing unit 130 when the cover (not shown) is in the closed position. At this time, the content may be printed as the paper p passes between the first printing unit 130 and the second printing unit 140.

The paper p may be wound in the form of a roll and accommodated in the cartridge 810. The accommodated paper p may be printed by a thermal head (not shown) of the first printing unit 130 and pulled out in the predetermined direction by a feed roller (not shown) of the second printing unit 140. The feed roller (not shown) may be configured to rotate in the direction opposite to the direction in which the paper p is unwound, and apply pressure to the thermal head (not shown) to thereby convey the paper p. In another embodiment, the first printing unit 130 may include a feed roller (not shown), and the second printing unit 140 may include a thermal head (not shown).

Figure 9:
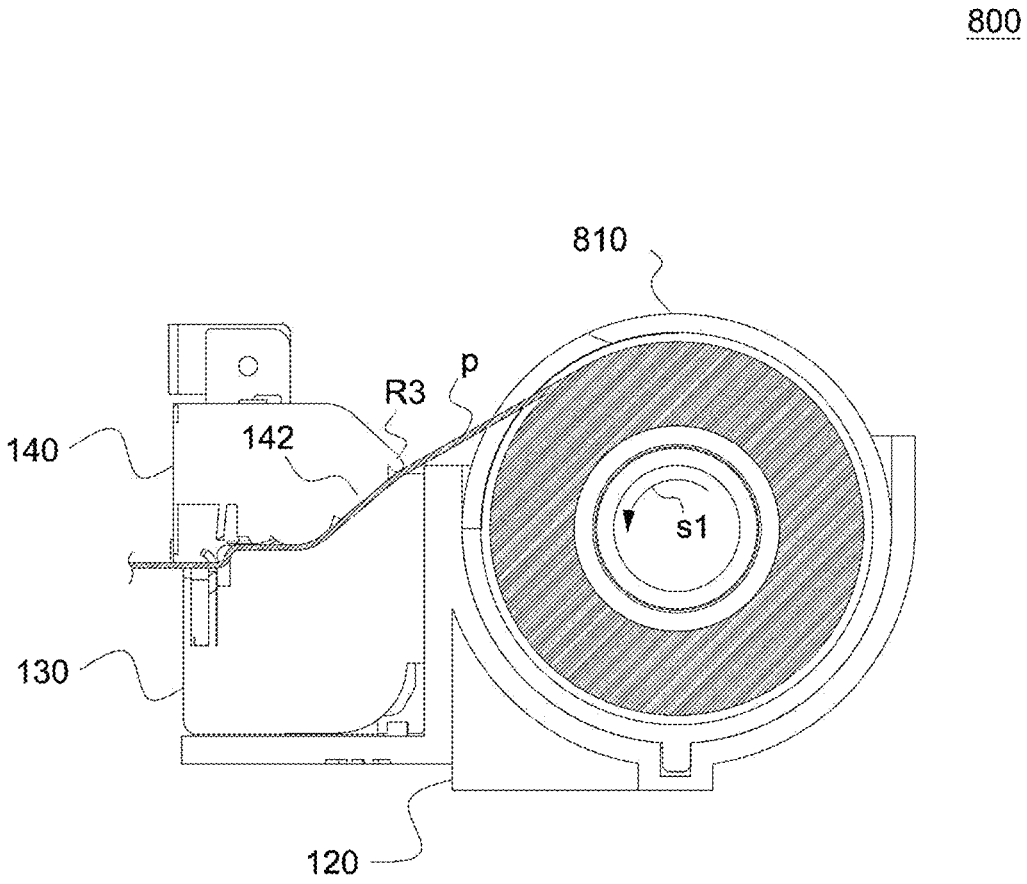
FIG. 9 is a cross-sectional view of a printer without a decurl guide part illustrating a path through which paper is drawn out.

FIG. 9 is a cross-sectional view of a printer 800 without a decurl guide part illustrating a path through which paper p is drawn out. As described above, when the decurl guide part R1 is formed on the cartridge 110, the rolled-up paper p is decurled in the decurl direction by the decurl guide part R1 and the decurling part R3 as the paper p is drawn out from the cartridge 110. On the other hand, in the illustrated printer 800, the paper p is not decurled when it is pulled out from the cartridge 810 since a decurl guide part R1 is not formed on the cartridge 810.

Thus, when the decurling part R3 is formed on the second printing unit 140, the printer may selectively perform decurling of the paper p without changing the configuration of the printer body by selectively using the cartridge 110 having the decurl guide part R1 or the cartridge 810 without the decurl guide part R1. For example, in the case of thick paper p that does not require decurling, the cartridge 810 in which a decurl guide part R1 is not formed thereon may be used. In the case of thin paper p that requires decurling, the cartridge 110 in which the decurl guide part R1 is formed thereon may be used.

For example, if decurling is performed on thick paper, the drive motor of the feed roller (not shown) may be overloaded, which may shorten the replacement cycle of the feed roller (not shown) and cause frequent breakdowns. In addition, if decurling is performed on a paper comprising a sticker paper and a release paper adhered thereto (e.g., label paper), the release paper may be separated from the sticker paper. In this case, it is preferable to use the cartridge 810 in which a decurl guide part R1 is not formed thereon.

Figure 10:
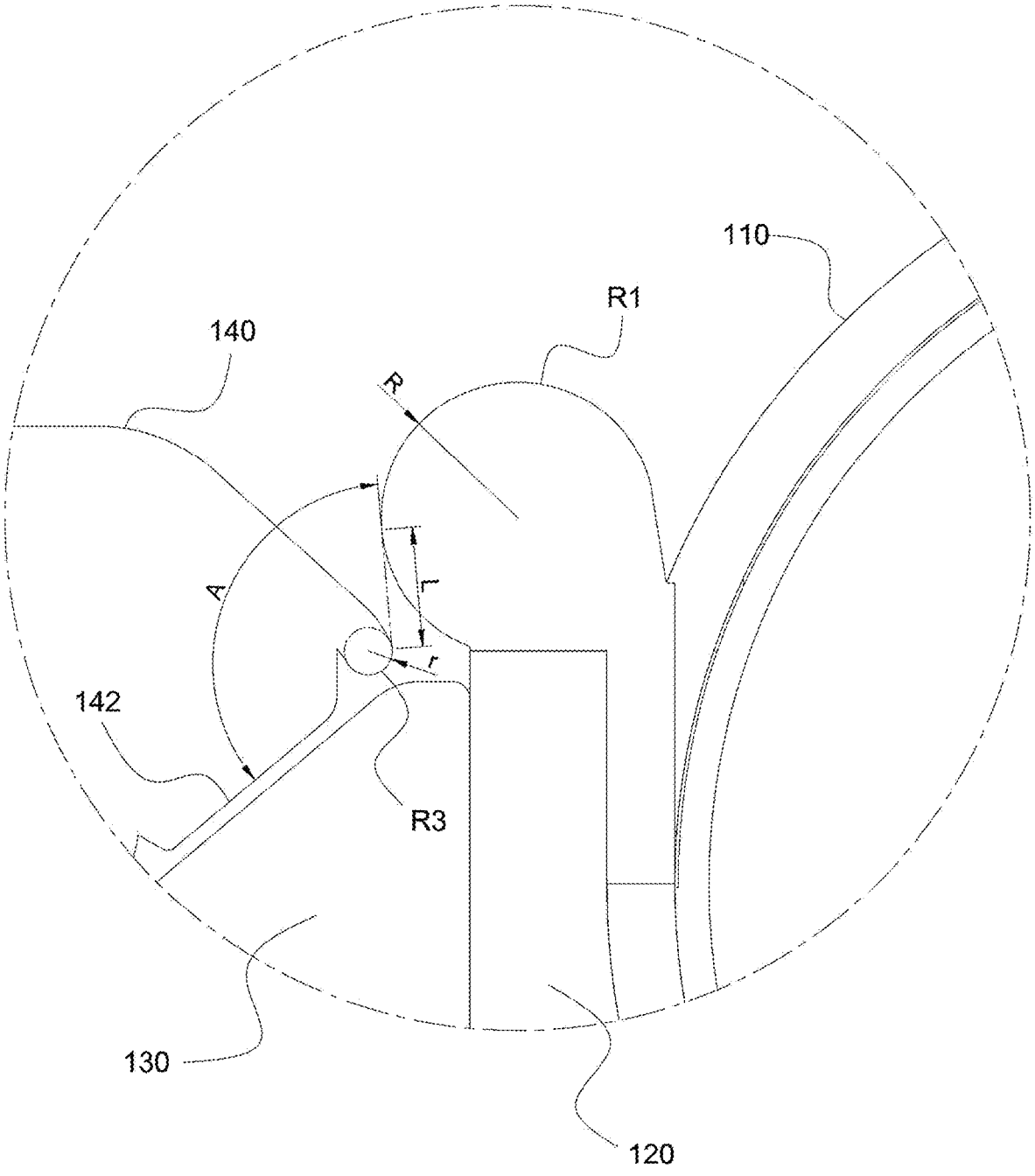
FIG. 10 is a diagram illustrating the detailed structure of the decurl guide part and decurling part.

FIG. 10 is a diagram illustrating the detailed structure of the decurl guide part R1 and decurling part R3. According to one embodiment, the decurl guide part R1 may be formed on the cartridge 110, and the decurling part R3 and the paper guide part 142 may be formed on the second printing unit 140. While the paper is drawn out, the decurl guide part R1 may come into surface-contact with the lower side of the paper, and the decurling part R3 and the paper guide part 142 may come into surface-contact with the upper side of the paper.

As illustrated, a portion of the decurling part R3 that comes into surface-contact with the paper may be formed as a curved surface having a first curvature radius r, and a portion of the decurl guide part R1 that comes into surface-contact with the paper may be formed as a curved surface having a second curvature radius R. Herein, in the tangent line contacting the decurling part R3 and the decurl guide part R1, the distance between the point of contact with the decurling part R3 and the point of contact with the decurl guide part R1 is referred to as the paper contact distance L. In addition, the angle between the paper guide part 142 and the decurling part R3 formed on the second printing unit 140 and the tangent line contacting the decurling part R3 and the decurl guide part R1 is referred to as the paper entry angle A. As shown, the paper entry angle is formed at an obtuse angle.

The paper contact distance L indicates the shortest distance where the paper is in surface-contact with the decurl guide part R1 and the decurling part R3 when the paper passes through the space between the decurl guide part R1 and the decurling part R3. The paper entry angle A represents an angle formed by the paper when the decurling part R3 applies pressure to the paper in the decurl direction. The load applied to the drive motor of the feed roller and the decurl amount of the paper are affected by at least the first curvature radius r, the second curvature radius R, the paper contact distance L, and the paper entry angle A.

Figure 11:
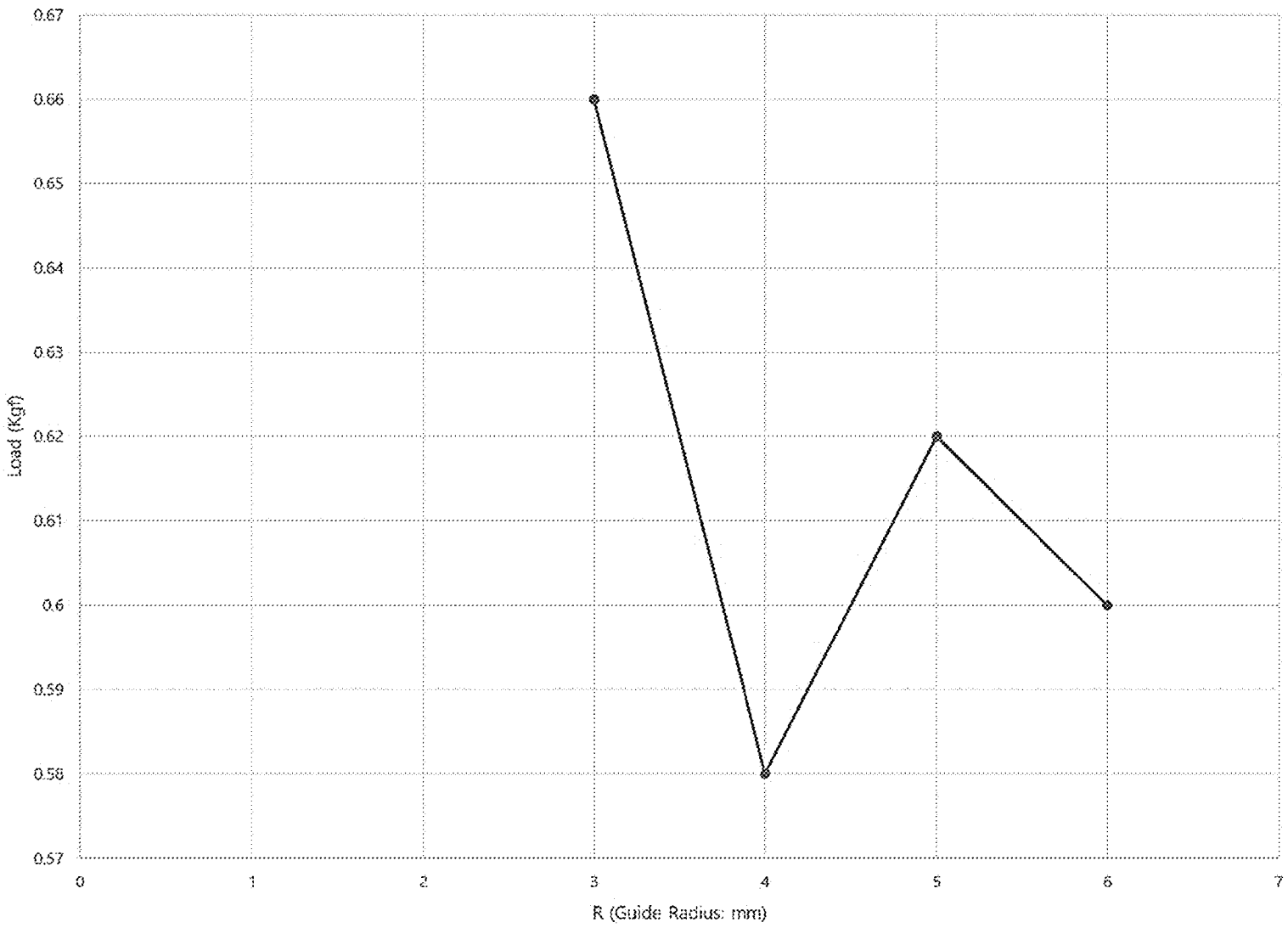
FIG. 11 is a graph illustrating measured values of load applied to a drive motor of a feed roller as the second curvature radius of the decurl guide part changes.

FIG. 11 is a graph illustrating measured values of load (unit: kgf) applied to a drive motor of a feed roller as the second curvature radius R (unit: mm) of the decurl guide part changes. The load (unit: kgf) applied to the drive motor of the feed roller was measured while changing the second curvature radius R (unit: mm) of the decurl guide part R. The first curvature radius r of the decurling part R3 was fixed to 0.7 mm. If the load applied to the drive motor of the feed roller is excessively large, it may cause a breakdown of the drive motor. Thus, the load applied to the drive motor needs to be kept below a certain level.

As shown, the load applied to the drive motor of the feed roller tends to decrease as the second curvature radius R of the decurl guide part R1 increases. The load applied to the drive motor of the feed roller is at a minimum value when R=4 mm. Even if the second curvature radius R of the decurl guide part R1 becomes larger than 4 mm, the load applied to the drive motor of the feed roller does not decrease. Instead, the volume of the printer increases. Thus, when the first curvature radius r of the decurling part R3 is 0.7 mm, it is preferable to design the second curvature radius R of the decurl guide part R1 to be 4 mm considering the load applied to the drive motor of the feed roller and the volume of the printer.

Figure 12:
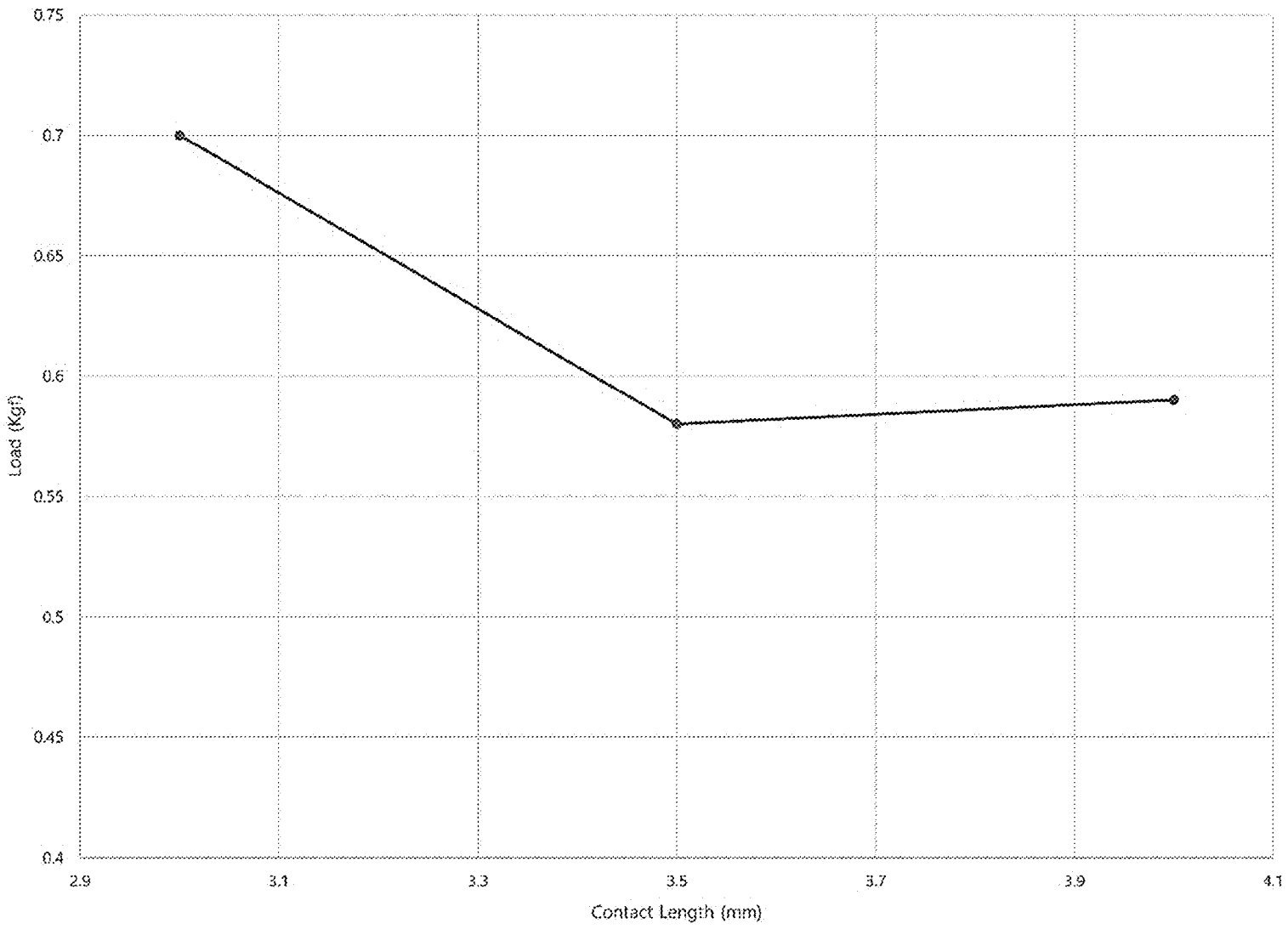
FIG. 12 is a graph illustrating measured values of load applied to a drive motor of a feed roller as the paper contact distance changes.

FIG. 12 is a graph illustrating measured values of load (unit: kgf) applied to a drive motor of a feed roller as the paper contact distance L (unit: mm) changes. The load (unit: kgf) applied to the drive motor of the feed roller was measured while changing the paper contact distance L (unit: mm). The first curvature radius r of the decurling part R3 and the second curvature radius R of the decurl guide part R1 was fixed to 0.7 mm and 4 mm, respectively. As shown, the load applied to the drive motor of the feed roller tends to decrease as the paper contact distance L increases. However, when the paper contact distance L is greater than 3.5 mm, the load applied to the drive motor slightly increases. Thus, when the first curvature radius r of the decurling part R3 is 0.7 mm and the second curvature radius R of the decurl guide part R1 is 4 mm, it is preferable to design the paper contact distance L to be 3.5 mm considering the load applied to the drive motor of the feed roller and the volume of the printer.

Figure 13:
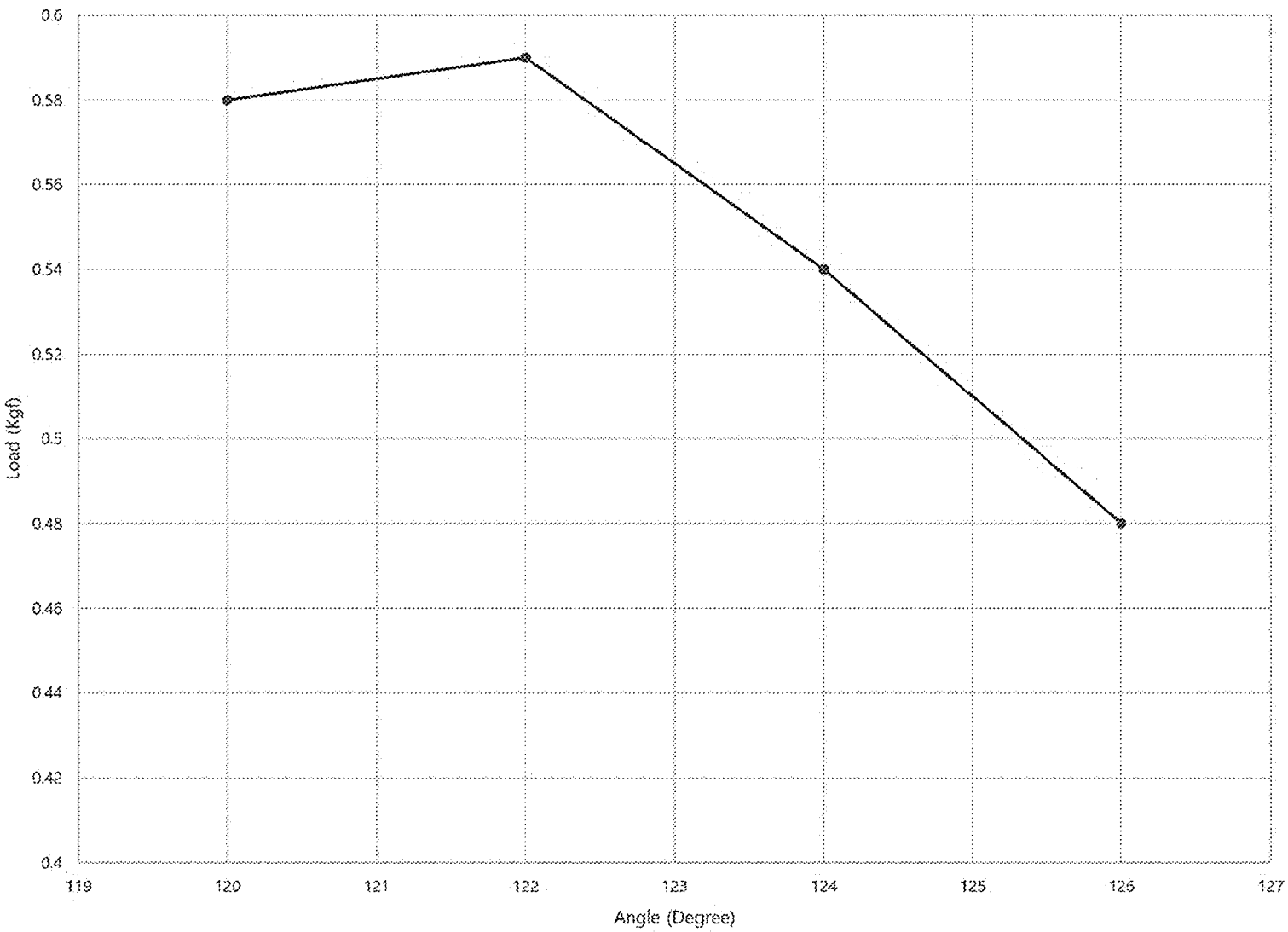
FIG. 13 is a graph illustrating measured values of load applied to a drive motor of a feed roller as the paper entry angle changes.

FIG. 13 is a graph illustrating measured values of load (unit: kgf) applied to a drive motor of a feed roller as the paper entry angle A (unit: degree) changes. The load (unit: kgf) applied to the drive motor of the feed roller was measured while changing the paper entry angle A. The first curvature radius r of the decurling part R3, the second curvature radius R of the decurl guide part R1, and the paper contact distance L was fixed to 0.7 mm, 4 mm, and 3.5 mm, respectively. As shown, the load applied to the drive motor gradually increases as the paper entry angle A increases from 120 degrees to 122 degrees, and the load applied to the drive motor tends to rapidly decrease as the paper entry angle A increases from 122 degrees to 126 degrees.

Figure 14:
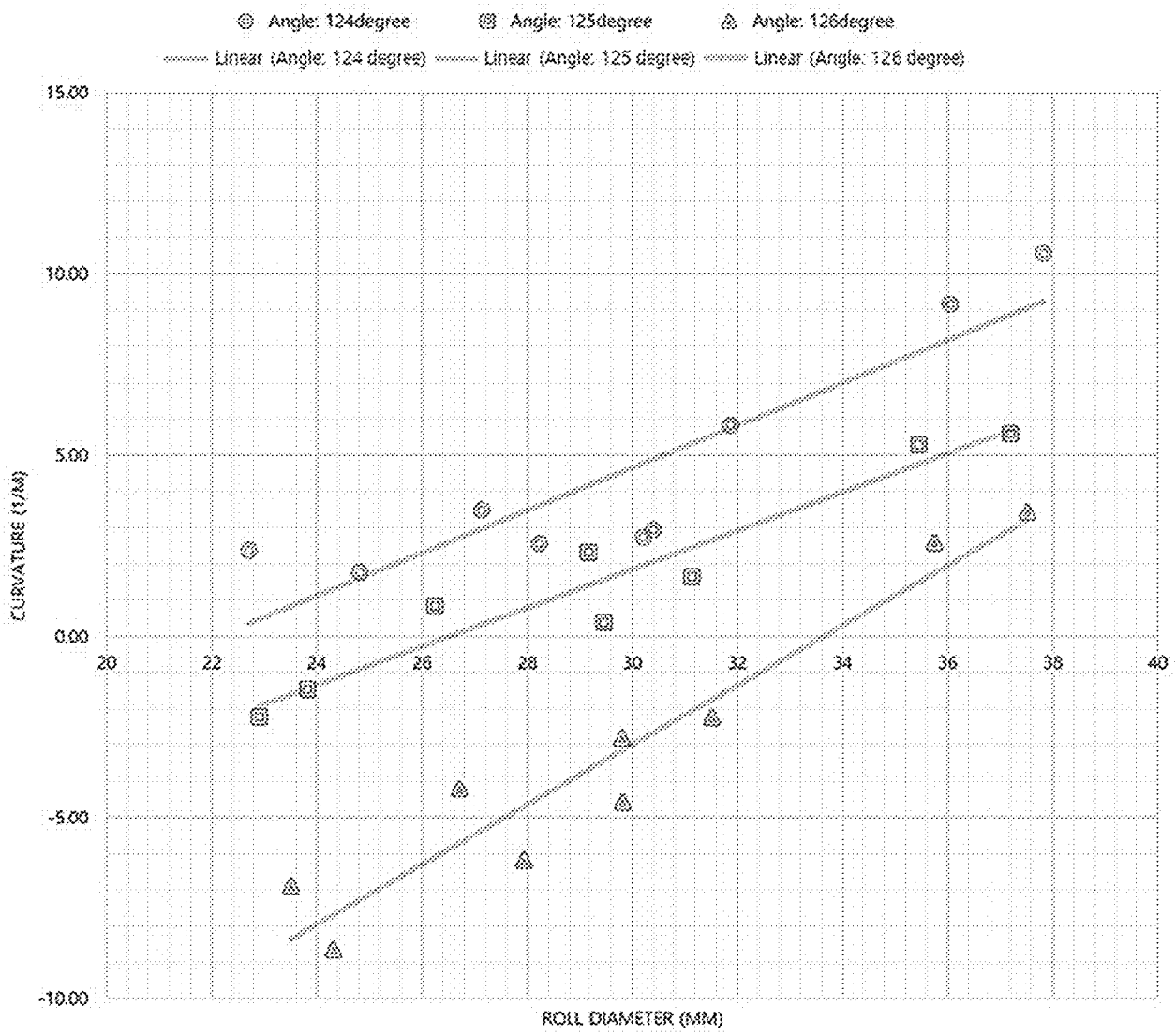
FIG. 14 is a graph illustrating measured values of curvature of output paper (unit: 1/M) as the paper entry angle changes.

FIG. 14 is a graph illustrating measured values of curvature of output paper (unit: 1/M) as the paper entry angle A (unit: degree) changes. The change in curvature of the output paper according to the roll diameter of the paper in the cartridge is shown for the cases where A (paper entry angle)=124 degrees, 125 degrees and 126 degrees. Herein, the first curvature radius r of the decurling part R3, the second curvature radius R of the decurl guide part R1, and the paper contact distance L are fixed at 0.7 mm, 4 mm, and 3.5 mm, respectively. The data points represented by double circles in the graph indicate the curvature of the output paper as the diameter of the paper roll in the cartridge changes while the paper entry angle A is fixed at 124 degrees. The data shown by double rectangles in the graph indicate the curvature of the output paper as the diameter of the paper roll in the cartridge changes while the paper entry angle A is fixed at 125 degrees. The data points represented by double triangles in the graph indicate the curvature of the output paper as the diameter of the paper roll in the cartridge changes while the paper entry angle A is fixed at 126 degrees.

As shown, when the paper entry angle A is 124 degrees, the curvature of the output paper has positive values in all sections. However, the paper is decurled excessively when the diameter of the paper roll is large. On the other hand, when the paper entry angle A is 126 degrees, decurling of the paper is not performed well since the curvature values of the output paper mostly have negative values where the diameter of the roll paper is not large. When the paper entry angle A is 125 degrees, decurling of the paper is well performed since the curvature values of the output paper are most closely distributed to zero and have more positive values than negative values. Thus, when the first curvature radius r of the decurling part R3 is 0.7 mm, the second curvature radius R of the decurl guide part R1 is 4 mm, and the paper contact distance L is 3.5 mm, it is preferable to set the paper entry angle A to 125 degrees.

Figure 15:
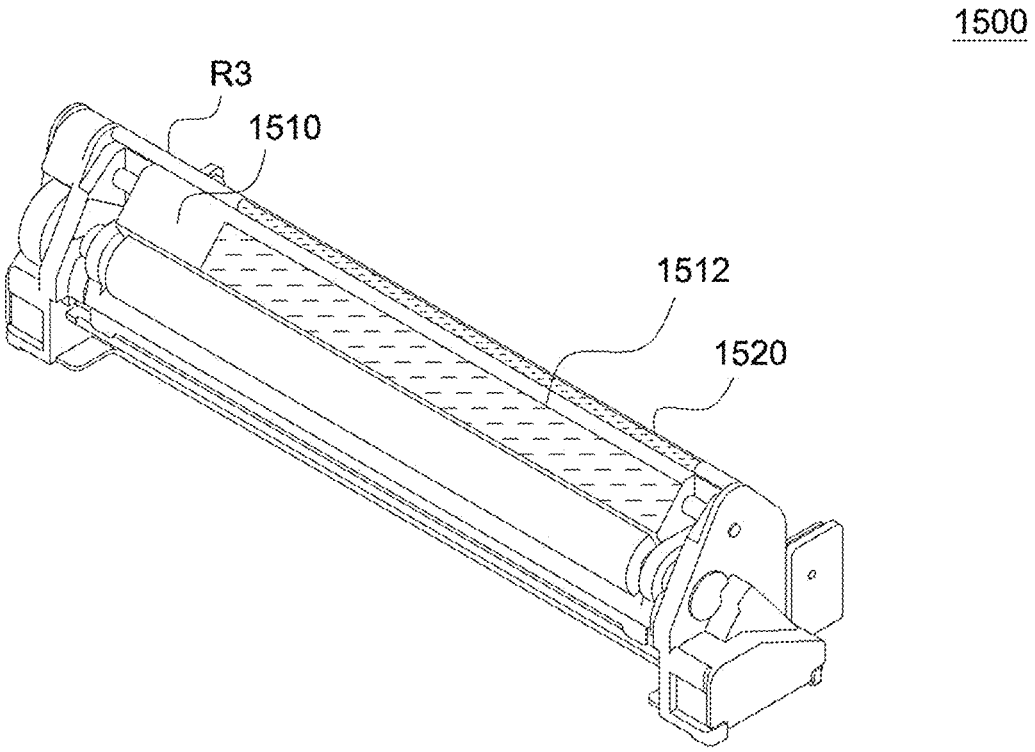
FIG. 15 is a diagram illustrating a paper jam prevention structure of a second printing unit according to an embodiment of the present disclosure.

FIG. 15 is a diagram illustrating a paper jam prevention structure of a second printing unit 1500 according to an embodiment of the present disclosure. As for note paper, when an adhesive portion is formed along one side of the paper, the adhesive portion of the paper may come into contact with the decurl guide part R1, the decurling part R3, and the paper guide part 1510 when the paper is discharged from the paper cartridge to the outside of the printer. Such contact may cause a paper jam. In this case, the paper may not be discharged properly, which may cause a printer breakdown.

In order to solve such a problem, a step may be formed in the decurl guide part R1, the decurling part R3 and the paper guide part 1510 such that the adhesive portion of the paper does not come into direct contact with the decurl guide part R1, the decurling part R3, and the paper guide part 1510. In one embodiment, in order to create a step at a portion corresponding to a path where the adhesive portion of the paper passes through, tape may be attached to portions of the decurl guide part R1, the decurling part R3, and the paper guide part 1510 where the adhesive portion of the paper does not pass. For example, as shown, the first tape 1512 may be attached to a portion of the paper guide part 1510 where the adhesive portion of the paper does not pass through. In this case, a step is formed in the paper guide part 1510 by configuring the height of the portion corresponding to the movement path of the adhesive portion of the paper to be lower than the height of the portion where the adhesive portion of the paper does not pass.

In addition, the second tape 1520 may be attached to a portion of the decurling part R3 where the adhesive portion of the paper does not pass through. In this case, a step may be formed in the decurling part R3 by configuring the height of the portion corresponding to the movement path of the adhesive portion of the paper to be lower than the height of the portion where the adhesive portion of the paper does not pass. Similarly, tape (not shown) may be attached to a portion of the decurl guide part R1 where the adhesive portion of the paper does not pass through. In this case, a step may be formed in the decurl guide part R1 by configuring the height of the portion corresponding to the movement path of the adhesive portion of the paper to be lower than the height of the portion where the adhesive portion of the paper does not pass. Thus, while the paper in the cartridge is pulled out of the printer, the adhesive portion of the paper does not come into direct contact with the surfaces of the decurl guide part R1, the decurling part R3, and the paper guide part 1510, thereby preventing malfunctioning of the printer that may be caused by the adhesive portion of the paper.

The embodiments of the present invention described above have been disclosed for the purpose of illustration, and various changes, modifications, and additions may be made within the spirit and scope of the invention by those skilled in the art. These modifications, changes, and additions are to be regarded as belonging to the scope of the claims of the present invention.

Since the above-described embodiments of the present invention may be variously substituted, modified, and changed by one of ordinary skill in the art without departing from the scope of the technical concept of the present invention, the present invention is not limited to the above-described embodiments and the attached drawings.

What is claimed is:

1. A printer for pulling out a paper wound in a form of a wound roll, comprising:

a cartridge configured to accommodate the paper;

a housing in which the cartridge is mounted;

a cover moveable between an open position for opening the top surface of the housing and a closed position for closing the top surface of the housing;

a first printing unit mounted to the housing; and a second printing unit mounted to the cover, wherein the paper is configured to be pulled out between the first printing unit and the second printing unit, and wherein the second printing unit comprises:

a protrusion-shaped decurling part having a first curvature radius, and configured to surface-contact with an upper side of the paper in a process of pulling out the paper when the cover is in the closed position; and a paper guide part having an inclined surface configured to surface-contact with the upper side of the paper in the process of pulling out the paper when the cover is in the closed position, and wherein a first height from a bottom surface of the housing to a first center of the first curvature radius of the protrusion-shaped decurling part is greater than a second height from the bottom surface of the housing to an upper end portion of the inclined surface of the paper guide part, and wherein the decurling part is configured to press the paper such that a portion of the paper, contacted with the decurling part, is angled at an obtuse angle.

2. The printer according to claim 1, the cartridge comprises a decurl guide part configured to surface-contact with a lower side of the paper in the process of pulling out the paper.

3. The printer according to claim 2, wherein a portion of the decurl guide part, configured to contact with the paper, has a second curvature radius, and the first curvature radius is smaller than the second curvature radius.

4. The printer according to claim 3, wherein a third height from the bottom surface of the housing to a second center of the second curvature radius of the decurl guide part is greater than a fourth height from the bottom surface of the housing to a rotational center axis of the paper in the housing.

5. The printer of claim 4, wherein the third height from the bottom surface of the housing to the second center of the second curvature radius of the decurl guide part is greater than the first height from the bottom surface of the housing to the first center of the first curvature radius of the decurling part.

6. The printer of claim 5, wherein the second center of the curvature radius of the decurl guide part is disposed between the rotational center axis of the paper in the housing and the first center of the first curvature radius of the decurling part, and the paper is decurled by a pressure applied by the decurling part while passing through a space between the second center of the second curvature radius of the decurl guide part and the first center of the first curvature radius of the decurling part.

7. The printer according to claim 3, wherein the decurl guide part comprises a first step such that a fifth height of a portion of the first step, corresponding to a path where an adhesive portion of the paper passes through, is lower than a sixth height of a portion of the first step, corresponding to a path where the adhesive portion of the paper does not pass through, and the decurling part comprises a second step such that a seventh height of a portion of the second step, corresponding to the path where the adhesive portion of the paper passes through, is lower than an eight height of a portion of the second step, corresponding to the path where the adhesive portion of the paper does not pass through.

8. The printer according to claim 1, wherein the decurling part is configured to apply pressure to the upper portion of the paper in a direction opposite to a direction in which the paper is wound in the cartridge thereby decurling the paper being pulled out.

9. The printer according to claim 1, wherein the second printing unit is disposed at a position facing the first printing unit when the cover is in the closed position, and wherein the first printing unit comprises a thermal head configured to perform printing on the paper and the second printing unit comprises a feed roller configured to rotate in a direction opposite to the direction in which the paper is unwound while pressing the thermal head to convey the paper, or the second printing unit comprises a thermal head configured to perform printing on the paper and the first printing unit comprises a feed roller configured to rotate in a direction opposite to a direction in which the paper is unwound while pressing the thermal head to convey the paper.

* * * * *